US006227303B1

(12) United States Patent
Jones

(10) Patent No.: US 6,227,303 B1
(45) Date of Patent: May 8, 2001

(54) WELL SCREEN HAVING AN INTERNAL ALTERNATE FLOWPATH

(75) Inventor: Lloyd G. Jones, Dallas, TX (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/290,605

(22) Filed: Apr. 13, 1999

(51) Int. Cl.[7] ..... E21B 43/08
(52) U.S. Cl. ..... 166/378; 166/231
(58) Field of Search ..... 166/278, 51, 280, 166/233, 232, 242.1, 234, 276, 116, 378, 380

(56) References Cited

U.S. PATENT DOCUMENTS

| | | | | |
|---|---|---|---|---|
| 4,945,991 | | 8/1990 | Jones . | |
| 4,964,464 | | 10/1990 | Myers | 166/278 |
| 5,082,052 | | 1/1992 | Jones et al. . | |
| 5,113,935 | | 5/1992 | Jones et al. . | |
| 5,330,003 | * | 7/1994 | Bullick | 166/278 |
| 5,341,880 | | 8/1994 | Thorstensen et al. . | |
| 5,355,949 | | 10/1994 | Sparlin et al. | 166/236 |
| 5,394,938 | * | 3/1995 | Cornette et al. | 166/51 |
| 5,419,394 | | 5/1995 | Jones . | |
| 5,476,143 | | 12/1995 | Sparlin et al. . | |
| 5,505,260 | * | 4/1996 | Andersen et al. | 166/278 |
| 5,515,915 | | 5/1996 | Jones et al. . | |
| 5,551,513 | * | 9/1996 | Surles et al. | 166/278 |
| 5,842,516 | * | 12/1998 | Jones | 166/56 |
| 5,868,200 | * | 2/1999 | Bryant et al. | 166/51 |
| 5,890,533 | * | 4/1999 | Jones | 166/51 |

* cited by examiner

*Primary Examiner*—Frank Tsay

(57) ABSTRACT

A well screen having an internal alternate flowpath for delivering gravel slurry to different levels within a well annulus and a method for assembling same. The screen is comprised of an outer pipe which is concentrically positioned over a base pipe so that an annulus is formed therebetween. Both pipes are perforated along their respective lengths but only part way around their respective circumferences. The respective perforated sections radially align with each other when the pipes are assembled. A plurality of longitudinal ribs isolate the annulus adjacent the perforated sections (i.e. production side of screen) from the annulus adjacent the non-perforated sections (i.e. alternate flowpath side of screen). At least one outlet is provided through the non-perforated section of the outer pipe to provide an outlet from the internal alternate flowpath.

16 Claims, 2 Drawing Sheets

WELL SCREEN HAVING AN INTERNAL ALTERNATE FLOWPATH

DESCRIPTION

1. Technical Field

The present invention relates to a gravel pack well screen and in one of its aspects relates to (a) a well screen for gravel packing a well which has an internal, alternate flowpath formed between two concentric pipes for delivering gravel slurry to spaced points within the well annulus around the well screen and (b) a method for assembling the screen.

2. Background of the Invention

In producing hydrocarbons or the like from certain subterranean formations, it is common to produce large volumes of particulate material (e.g . . . sand) along with the formation fluids which must be controlled or it can seriously affect the economic life of the well. One of the most commonly-used techniques for controlling sand production is known as "gravel packing". In a typical gravel pack completion, a screen is positioned within the wellbore adjacent the interval to be completed and a gravel slurry is pumped down the well and into the well annulus around the screen. As liquid is lost from the slurry into the formation and/or through the screen, gravel is deposited around the screen to form a permeable mass around the screen. This gravel is sized to allow produced fluids to flow therethrough but block the flow of any particulate material into the screen.

A major problem in gravel packing—especially where long or inclined intervals are to be completed—lies in adequately distributing the gravel over the entire completion interval, i.e. completely packing the well annulus along the length of the screen. Poor distribution of gravel (i.e. voids in the gravel pack) is often caused when liquid from the gravel slurry is lost prematurely into the more permeable portions of the formation thereby causing "sand bridge(s)" to form in the annulus before all of the gravel has been placed. These sand bridges effectively block further flow of the slurry through the annulus thereby preventing delivery of gravel to all parts of the completion interval.

To alleviate this problem, "alternate-path" well tools e.g . . . well screen) are now in use which provide good distribution of gravel throughout the entire completion interval even when sand bridges form before all of the gravel has been placed. Such tools include perforated shunts or by-pass conduits which extend along the length of the tool and which are adapted to receive gravel slurry as it enters the well annulus around the tool. If a sand bridge forms in this annulus, the slurry can still pass through the perforated shunt tubes (i.e. alternate-paths) to different levels in the annulus above and/or below the bridge. For a more complete description how such well tools (e.g . . . gravel-pack screens) operate, see U.S. Pat. No. 4,945,991, which is incorporated herein by reference.

In many prior-art, alternate-path well screens, the individual shunts tubes are carried externally on the outer surface of the screen; see U.S. Pat. Nos. 4,945,991; 5,082,052; 5,113,935; 5,417,284; and 5,419,394. While this arrangement has proven highly successful, externally-mounted shunts do have some disadvantages. For example, by mounting the shunts externally on the screen, the effective, overall outside-diameter of the screen is increased. This can be very important especially when a screen is to be run into a relatively small-diameter wellbore where even fractions of an inch in its outer diameter may make the screen unusable or at least difficult to install in the well.

Another disadvantage in mounting the shunts externally is that the shunts are thus exposed to damage during assembly and installation of the screen. If the shunt is crimped or otherwise damaged during installation, it can become totally ineffective in delivering the gravel to all of the levels in the completion interval which, in turn, may result in the incomplete packing of the interval. Several techniques have been proposed for protecting these shunts by placing them inside the screen; see U.S. Pat. Nos. 5,341,880, 5,476,143, and 5,515,915. However, this typically makes the construction of such screen more sophisticated, if not more complicated, which, in turn, normally results in substantially higher production costs.

SUMMARY OF THE INVENTION

The present invention provides a gravel-pack, well screen having an internal alternate flowpath for delivering gravel slurry to different levels within a well annulus during a gravel pack operation. The distribution of gravel directly to different levels within the annulus from the internal alternate flowpath provides a better distribution of gravel throughout the completion interval especially when sand bridges form in the annulus before all of the gravel has been placed. By placing the alternate flowpath inside the screen, it is protected from damage and abuse during handling and installation of the screen and does not increase the effective diameter of the screen which normally occurs when external alternate flowpaths are used.

More specifically, the well screen of the present invention is comprised of a larger-diameter, outer pipe which is concentrically positioned over a base pipe whereby an annulus is formed between the two pipes. Both of the pipes have perforations along their respective lengths but only through a radial portion of their respective circumferences which provides each pipe with a respective perforated, radial section and a non-perforated, radial section which, in turn, radially align, respectively, when the pipes are concentrically positioned.

A plurality of ribs are formed onto or are secured to the base pipe and extend longitudinally through the annulus to isolate that portion of the annulus which lies adjacent the perforated sections of the pipes from that portion of the annulus which lies adjacent the non-perforated sections of the pipes. The annulus adjacent the perforated sections forms the production side of the screen while the annulus adjacent the non-perforated section forms the alternate flowpath through the screen.

While at least one outlet is provided through the non-perforated section of the outer pipe, preferably there are a plurality of outlets (preferably with hardened inserts therein) vertically spaced along the length of the non-perforated section of the outer pipe to thereby provide outlets for the gravel slurry to flow from the alternate flowpath into the different levels of the well annulus. The upper and the lower ends of the annulus are closed with plates or the like and an inlet is provided through the upper plate to allow the gravel slurry to flow only into the alternate flowpath side of the screen.

In operation, the screen is assembled and lowered on a workstring down to the production formation within the wellbore. Gravel slurry is pumped down the workstring and out of a cross-over into the well annulus surrounding the screen. As the slurry flows into the well annulus, it also flows through the inlet in the upper end of the annulus and into the alternate flowpath within the screen (i.e. annulus adjacent the non-perforated sections of the concentric pipes). If a sand bridge forms in the well annulus before all of the gravel has been placed in the annulus, slurry can flow through the internal alternate flowpath and out the outlets therein into the different levels of the well annulus to finish gravel packing the completion interval.

Once the gravel pack is complete, the cross-over, etc., is removed and the well is put on production. Fluids, produced from the formation, flow through the gravel pack, the perforations in both the outer pipe and the base pipe, and into the base pipe and then to the surface through a tubing string connected to the base pipe.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
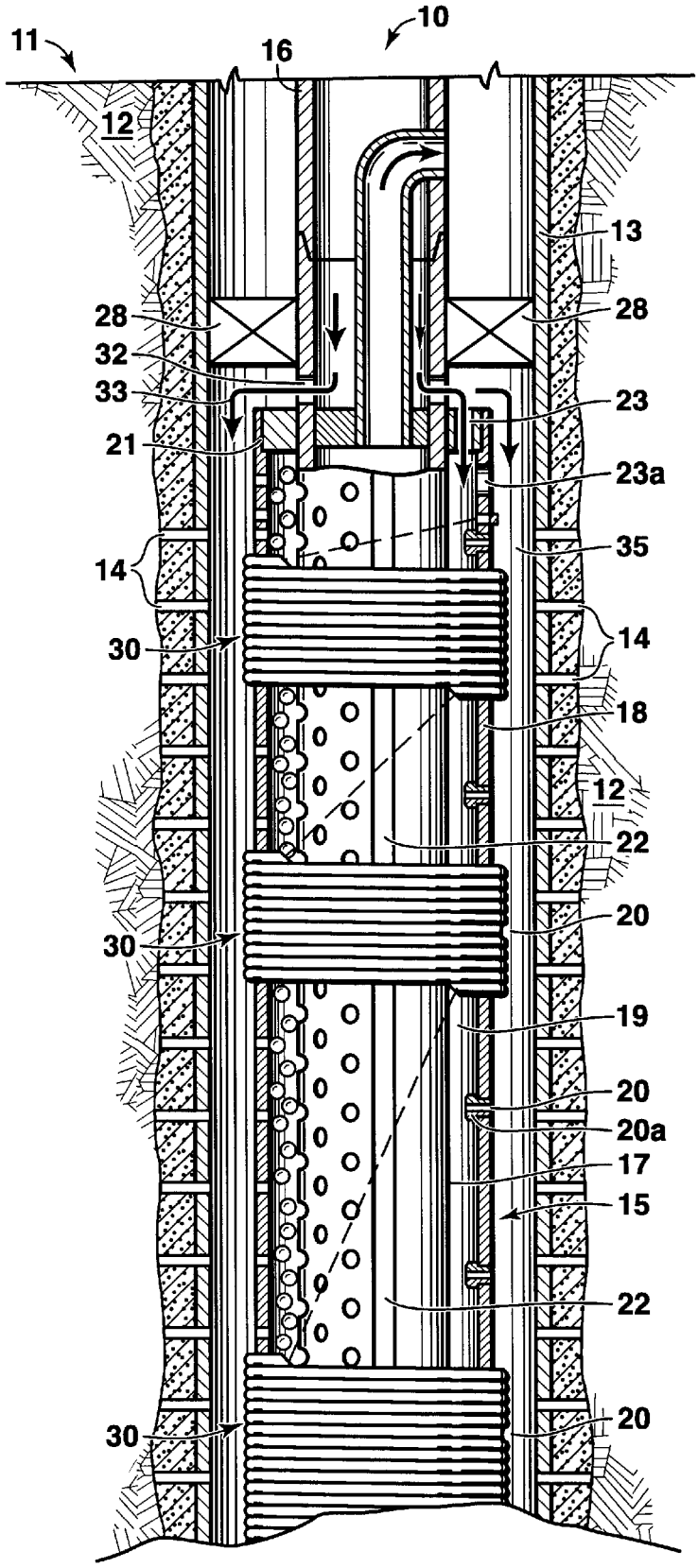
FIG. 1 is an elevational view, partly in section and cut-away, of a well tool in accordance with the present invention.

Referring more particularly to the drawings, FIG. 1 illustrates the present well tool 10 in an operable position within the lower end of a producing and/or injection wellbore 11. Wellbore 11 extends from the surface (not shown) and into or through formation 12. Wellbore 11, as shown, is cased with casing 13 having perforations 14 therethrough, as will be understood in the art. While wellbore 11 is illustrated as being a substantially vertical, cased well, it should be recognized that the present invention can be used equally as well in "open-hole" and/or underreamed completions as well as in horizontal and/or inclined wellbores. Well tool 10 (e.g . . . gravel pack screen) may be of a single length or it may be comprised of several joints (only the portion of the upper joint is shown) which are connected together with threaded couplings and/or blanks or the like which will be understood in the art.

As shown, a typical joint 15 of gravel pack screen 10 is comprised of a base pipe 17 which is fluidly connected to the lower end of a workstring 16 which, in turn, extends to the surface (not shown). Base pipe 17 is perforated along its length but only on one side of its circumference or a portion thereof (e.g. shown as being approximately one-half or around 180° of its circumference) to form a "perforated section" for a purpose which will become obvious below. The other side of base pipe 17 is solid along its length and has no perforations or openings therein to form a "non-perforated section". A larger-diameter, outer pipe or sleeve 18 is concentrically positioned over base pipe 17 and is spaced therefrom to thereby form an annulus 19 therebetween.

Outer pipe 18 is also perforated along its length and only on one side (i.e. 180° of its circumference); "perforated section", but has vertically-spaced outlets 20 along the other side ("non-perforated section") thereof. The perforated side or section of outer pipe 18 is radially aligned with the perforated side or section of base pipe 17 when screen 10 is assembled and ready for use whereby fluids can readily flow into the interior of base pipe 17 through the perforations in both outer pipe 18 and base pipe 17 as will be further described below.

Figure 2:
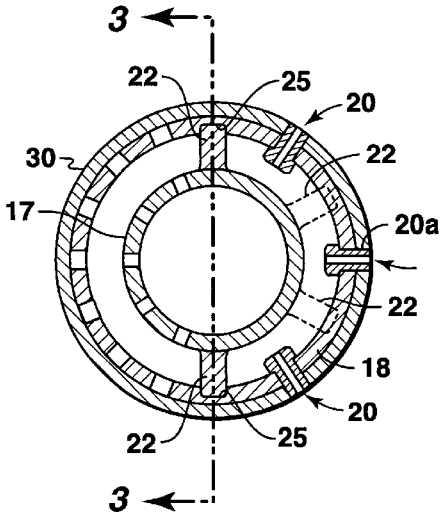
FIG. 2 is a cross-sectional view taken along line 2—2 of FIG. 1.
Figure 3:
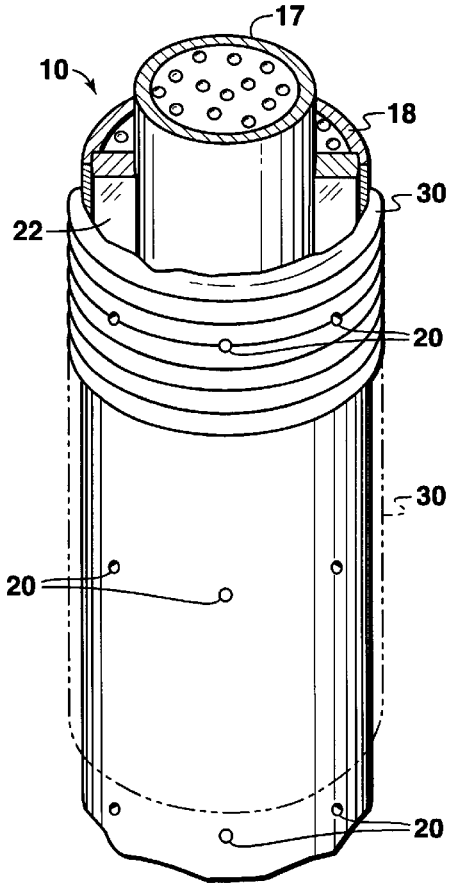
FIG. 3 is a perspective view, partly cut-away, taken along line 3—3 of FIG. 2.

A plurality of ribs 22, (e.g. a pair of ribs which are diametrically-opposed as illustrated in FIGS. 2 and 3), extend longitudinally through annulus 19 to sealingly divide and isolate the perforated sections of base pipe 17 and outer pipe 18 (i.e. production side) from the non-perforated sections of the pipes (i.e. alternate flowpath side) for a purpose discussed below. The upper and the lower ends of annulus 19 are closed with seal means (e.g. caps or plates 21—only top plate shown). An inlet(s) 23, 23*a*, respectively, is provided through top plate 21 and/or through the upper circumference of the non-perforated section of outer pipe 18 to provide an inlet for the slurry (i.e. solids) only into the "alternate flowpath" side of the screen.

Preferably, in assembling 10, the perforations in both the base pipe 17 and the outer pipe 18 are provided in the respective perforated sections thereof as described above. It should be recognized that, while screen 10 is illustrated as having perforations about approximately 180° of the circumference of the respective pipes, more or less of the respective circumferences may be perforated depending on the desired volumes of the production side vis-à-vis the alternate flowpath side, e.g. 75% of the respective circumferences could be perforated with the remaining 25% being non-perforated if greater volume was desired on the production side, and so forth. Also, more than two ribs 22 can be used to produce more than one alternate flowpath along the non-perforation section of the screen (see dotted lines 22 in FIG. 2)

As shown in FIGS. 2 and 3, one longitudinal edge (i.e. inner edge) of each rib 22 is welded or otherwise secured to base pipe 17 along its length. As shown, a pair of ribs are spaced diametrically-opposed to each other but again, it should be understood that other radial-spacing (e.g. 90° from each other) may be used to provide a larger or smaller alternate flowpath or a plurality of ribs 22 can be used to provide a plurality of alternate flowpaths (FIG. 2) as the situation may dictate. The other edges (i.e. outer edges) of ribs 22 are then slid into the longitudinally-extending slots 25 which, in turn, are formed along the inner wall of outer pipe 18 as inner pipe 17 and the attached ribs 22 are moved into position within outer pipe 18.

If the tolerances between the ribs and their respective slots are not such to prevent substantial leakage from the non-perforated section into the perforated section, a sealant (e.g. an epoxy resin or the like) can be used to seal between the ribs and the inner wall of outer pipe 18. The upper and lower ends of annulus 19 is then closed with plates 21 so that inlet(s) aligns with the alternate flowpath side of the screen. It will be understood that if more than one length or joint of well screen 10 is used in a particular gravel-pack operation, an outlet will be provided in the bottom plate (not shown) of an upper joint which will be fluidly-connected in the inlet 23 on an adjacent lower joint so that the alternate flowpath will be continuous throughout the entire length of the well screen.

Screen 10, as illustrated, has a continuous length of a wrap wire 30 wound onto the outer surface of outer pipe 18. Each coil of the wrap wire 30 is slightly spaced from the adjacent coils to form fluid passageways (not shown) between the respective coils of wire as is commonly done in may commercially-available, wire-wrap screens, e.g . . . BAKERWELD Gravel Pack Screens, Baker Sand Control, Houston, Tex. Spaced outlets 20 can be pre-formed in the non-perforated section of outer pipe 18 or they can be drilled after wrap wire 30 is in place. Also, each outlet 20 preferably has a hardened insert 20*a* therein to reduce erosion of the outlet during placement of the gravel, see U.S. Pat. No. 5,842,516, issued Dec. 1, 1998, and incorporated herein by reference.

Figure 4:
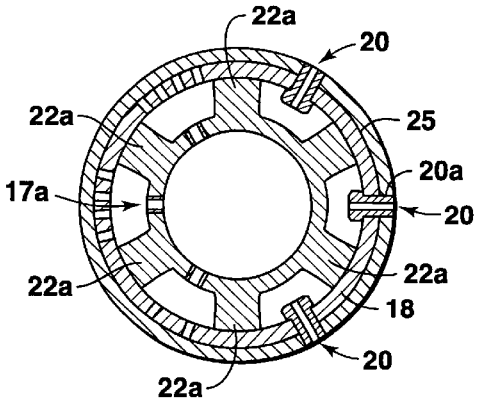
FIG. 4 is a cross-sectional view, similar to that of FIG. 2, of a further embodiment of the present invention.

While ribs 22 can be separate elements of structure which are assembled into screen 10 as discussed above, the ribs 22*a* may also be formed as an integral part of inner pipe 17*a* (FIG. 4). By casting or otherwise forming inner pipe 17*a* with integral ribs 22*a* thereon, there may be substantial savings in the manufacturing costs of the screen. In this embodiment, the outer pipe 18 will merely be positioned over the inner pipe 17*a* with a sealant applied between the outer ends of ribs 22*a* and the outer pipe 18.

In a typical gravel pack operation using the present invention, screen 10 is assembled and lowered into wellbore 11 on workstring 16 until it is positioned adjacent to formation 12 and packer 28 is set, as will be understood in the art. Gravel slurry (arrows 33 in FIG. 1) is then pumped down the workstring 16, out through ports 32 in "cross-over" 34, and into the well annulus 35 which surrounds well screen 10. The inlet(s) 23 in upper plate 21 is open to also receive the gravel slurry as it enters well annulus 35.

As the gravel slurry flows downward in annulus 35 around the screen 10, it will lose liquid to formation 12 and/or through the screen, itself. The gravel carried in the slurry is deposited and collects in the annulus 35 to form a gravel pack around the screen 10. If too much liquid is lost from the slurry before the annulus is filled, a sand bridge (not shown) is likely to form in the annulus 35 thereby blocking further flow therethrough which, in turn, prevents further filling of the annulus 35 below the bridge.

In the present invention, if a sand bridge forms before the gravel packing has been completed, the gravel slurry is now free to continue to flow downward through the alternate flowpath side of screen 10 and out the spaced outlets 20 therein to thereby by-pass the bridge and complete the gravel pack. During the gravel-pack operation, gravel cannot flow into base pipe 17 since wire wrap 30, while allowing flow of fluids therethrough, will effectively block the flow of the gravel. Also, since there are no inlets in to plate 21 on the production side of screen 10, no gravel can flow into the production side of annulus 19.

Once the gravel-pack operation is completed, cross-over 34 is removed on workstring 16 which, in turn, is typically replaced with a string of production tubing (not shown). Well 10 is then put on production whereupon fluids flow from formation 12, through the gravel-pack surrounding the screen, between the coils of wrap wire 30, and into base pipe 17 through the perforations in pipes 18 and 17 from which the fluids are then produced to the surface through the string of production tubing (not shown) which, in turn, is fluidly connected to the base pipe 17.

The distribution of gravel directly to the various levels in the well annulus 35 from the alternate flowpath within screen 10 provides a better distribution of gravel through the entire completion interval especially when said bridges form in the annulus before all of the gravel has been placed. Also, since the alternate flowpath is formed between the concentric pipes and is therefor positioned within the screen 10, it is protected from damage and abuse during handling and installation of the gravel pack screen.

What is claimed is:

1. A well screen comprising:

a base pipe having a perforated side and a solid side;

an outer, larger-diameter pipe concentrically-positioned over said base pipe thereby forming an annulus therebetween, said outer pipe having a perforated side and a solid side which radially-align with said perforated side and said solid side, respectively, of said base pipe when said pipes are concentrically positioned;

seal means for closing the upper end of said annulus;

means positioned within said annulus for isolating said radially-aligned, perforated sides of said base pipe and said outer pipe from said radially-aligned, solid sides of said base pipe and said outer pipe wherein said perforated sides of said base pipe and said outer pipe form a production side of said well screen and wherein said solid sides of said base pipe and said outer pipe form an alternate flowpath side of said well screen;

means for allowing flow of fluids into said production side of said well screen while blocking flow of solids into said production side of said screen;

at least one outlet in said alternate flowpath side of said well screen; and an inlet opening at the upper end of said annulus for allowing flow of solids only into said alternate flowpath side of said well screen.

2. The well screen of claim 1 wherein said means for allowing flow of fluids into said production side while blocking flow of solids comprises:

a continuous length of wire wrapped around the outer surface of said outer pipe, wherein each coil of said wire is spaced from the adjacent coils to thereby provide fluid passages between the coils of wire.

3. The well screen of claim 1 wherein said means for isolating said production side from said alternate flowpath side comprises:

a plurality of ribs extending longitudinally through said annulus and extending between said base pipe and said outer pipe, said ribs being radially-spaced from each other within said annulus to divide said annulus between said production side and said alternate flowpath side.

4. The well screen of claim 3 wherein said plurality of ribs comprise:

a pair of ribs which are positioned diametrically-opposed to each other within said annulus.

5. The well screen of claim 3 wherein each rib has an inner edge and an outer edge, and wherein said inner edge of each of said ribs is secured to said base pipe and the outer edge of each said rib is positioned within a respective longitudinally-extending slot formed within the inner wall of said outer pipe.

6. The well screen of claim 3 wherein said plurality of ribs comprise:

a plurality of ribs which are formed integrally on said inner pipe.

7. The well screen of claim 3 additionally comprising seal means for closing the lower end of said annulus.

8. The well screen of claim 1 wherein said at least one outlet comprises:

a plurality of outlets spaced along the length of said solid side of said outer pipe.

9. The well screen of claim 8 including:

a hardened insert positioned within each of said plurality of space outlets.

10. A method of assembling a well screen comprising:

positioning a base pipe within a larger-diameter outer pipe to form an annulus between said pipes;

providing perforations along the lengths of both said base pipe and said outer pipe but only through a portion of the respective circumference of each pipe to provide each pipe with a perforated, radial section and a non-perforated, radial section which radially align respectively, when said pipes are concentrically-positioned;

isolating that portion of said annulus which lies adjacent the aligned, perforated radial sections of said pipes from that portion of said annulus which lies adjacent aligned non-perforated radial sections of said pipes;

closing the upper end of said annulus;

providing an inlet through the upper end of said annulus only into said annulus adjacent said non-perforated radial sections of said pipes to allow the flow of solids into said non-perforated section of said annulus; and providing at least one outlet through the non-perforated radial section of said outer pipe for the outlet of said solids.

11. The method of claim 10 including:

wrapping wire around said outer pipe, leaving a space between adjacent coils of said wire to form passages therebetween which allow flow of fluids therethrough while blocking flow of solids there through.

12. The method of claim 11 wherein said base pipe and said outer pipe are provided with said perforations before the base pipe is positioned within said outer pipe.

13. The method of claim 11 including:

providing additional outlets through the non-perforated radial section of said outer pipe, said outlets being spaced longitudinally along the length of said outer pipe.

14. The method of claim 11 wherein said perforated and non-perforated portions of said annulus are isolated by securing one edge of each of a plurality of radially-spaced ribs to said base pipe, and positioning the other edge of each of said ribs into a respective longitudinally-extending groove formed within the inner wall of said outer pipe.

15. The method of claim 13 wherein said perforated and non-perforated portions of said annulus are isolated by radially-spaced ribs which are formed integral on said base pipe and which extend radially into engagement with said outer pipe.

16. The method of claim 15 additionally comprising the step of closing the lower end of said annulus.

* * * * *